US009861180B1

(12) United States Patent
Jungling

(10) Patent No.: US 9,861,180 B1
(45) Date of Patent: Jan. 9, 2018

(54) DUAL BEAM, VEHICLE MOUNTED HAMMOCK FRAME

(71) Applicant: FMH Trammock LLC, Wesley Chapel, FL (US)

(72) Inventor: David Brian Jungling, Wesley Chapel, FL (US)

( * ) Notice: Subject to any disclaimer, the term of this patent is extended or adjusted under 35 U.S.C. 154(b) by 0 days.

(21) Appl. No.: 15/620,327

(22) Filed: Jun. 12, 2017

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 4/08; A45F 3/24; A47C 17/80; A47C 3/0255; B60N 2/2854
See application file for complete search history.

(56) References Cited

U.S. PATENT DOCUMENTS 5,740,570 A * 4/1998 Hsieh ..... A45F 3/24 5/127
5,983,422 A * 11/1999 Bayless ..... A45F 3/24 5/120
9,179,759 B1 * 11/2015 Turner ..... A45F 3/22
2013/0117931 A1 * 5/2013 Lemmens ..... A45F 3/24 5/127
2016/0058197 A1 * 3/2016 Jungling ..... A45F 3/24 5/119

* cited by examiner

*Primary Examiner* — Eric J Kurilla
(74) *Attorney, Agent, or Firm* — Jackson Walker LLP

(57) ABSTRACT

The present invention is a vehicle mounted hammock frame having dual beams that resist torsion and rotation of the sidearm extensions. It allows for a hammock to be suspended in the bed of a pickup truck approximately 6 feet above ground level. Further, the sidearm extensions have a narrow and wide side such that when the frame is folded for storage the narrow extension nestles inside the wide extension. The extensions are rotatably attachable to the central crossbeam assembly via sidearm receivers and generally L-shaped sidearm guides. The extensions may be easily attached or detached from the sidearm guides by inserting or removing a hinge pin. Moving the frame can be made easier by attaching axles and wheels to the folded frame.

7 Claims, 6 Drawing Sheets

DUAL BEAM, VEHICLE MOUNTED HAMMOCK FRAME

BACKGROUND OF THE INVENTION

Field of the Invention

Applicants' invention relates to a device for suspending a hammock. More particularly, it relates to a hammock frame that is mountable inside a pick-up truck bed.

Background Information

Hammocks are popular around the world for relaxation and sleeping. They can be used for lounging or ads a lightweight bed on camping trips. The hammock conjures an image of leisure and relaxation.

Conventional hammocks are slings, suspended between two (2) or more anchor points, for a person to lie or sit in. The sling portion of the hammock is generally made from a fabric sheet, such as cotton or nylon, or corded netting, often made from nylon, poly, fiber, or cotton. The hammock may be used for swinging, sleeping, or resting.

The hammock sling normally consists of one or more cloth panels, or a woven network of twine or thin rope. This creates a sheet, albeit a sheet that may have holes, on which a person may lie.

The anchor points need to be an appropriate distance apart—close enough to tie the ends of the hammock (or cables tied to the ends of the hammock) to, but far enough apart to allow the user to rest between. Because the hammock will need to support the weight of the user (or sometimes multiple users), the sling portion and the tie straps must be of sufficient tear resistance to accommodate such a load. Additionally, with the hammock hanging from the anchor points, the anchor points must also be sufficiently strong to support the user's weight.

The anchor points are generally either existing structures—whether made-made such as posts or walls, or natural such as trees—or frames that stand alone with two end-points for attaching to the hammock ends or tie straps.

There are a wide variety of hammocks available, as well as accessories for them. There are light-weight, packable hammocks that are designed specifically for backpacking that may include rain flys, mosquito netting, or storage pockets. There are hammocks made for placement in the user's yard or beach that are purely for relaxation.

Hammocks come in a variety of colors, patterns, and sizes ranging from holding one person to two or three persons. There are even hammocks intended to take the place of a tent. Common dimensions for unslung hammocks fall in a range between 370.9 m to 14'/4.2 m across and 6'/1.8 m to 11'/3.3 m long.

One of the many hammock styles is framed, sometimes called a spreader-bar style. The spreader-bar hammock is easily recognized by wooden or metal bars at the head and foot of the hammock, spreading its width and allowing for easy access for casual use, such as in a backyard. Some framed hammocks may have a single-spreader bar, which uses a spreader bar on only one end and is much more stable. A variation of the single-spreader bar hammock has three attachment points, one at each corner of the spreader bar and one at the non-spreader bar end and is nearly untippable.

Various styles of hammocks available have different materials or construction. Some may be made of cotton or nylon string that is woven to form a net. A solid fabric may be used, which tends to be more durable than the string varieties. Camping hammocks are generally made of nylon or polyester.

Camping hammocks may have a ridgeline, which is generally in line strung between each end and above the hammock, from which additional gear, such as mosquito netting and rain flys are hung.

For non-spreader-bar styles, the way in which hammocks are hung is critical for comfort. Generally, a higher attachment point is preferred as well as sufficient length between attachment points, though these two dimensions can be adjusted to compensate for a lack in one or the other. The optimal angle of the attaching lines to the post/wall/tree is usually about 30 degrees.

Though one can lie in a hammock lengthwise or across its width, most hammocks are best used with a diagonal position, as it provides the most room and support. Users with back and joint pains often report some relief from these problems when sleeping in a hammock in this manner.

One favorite use for hammocks is for rest and relaxation at recreational events. The problem, is that often appropriate anchor points are not available. This could be because there are a great number of people at such events which limits the availability of anchor points, or room to locate a hammock. Or, in an area such as maybe a metropolitan or beach location, there may not be appropriate anchors regardless of the number of people. Another problem may be that in some areas, such as a parking lot tailgate party, there is simply no room for setting up a hammock. Another problem is that conventional hammocks frames are rather large and difficult to transport.

SUMMARY OF THE INVENTION

The present invention is the truck mounted hammock frame. It was developed as an accessory for recreational relaxation. With a hammock suspended in the bed of a pickup truck approximately 6 feet above ground level, views are unimpeded and scenic locations are endless so long as the truck can drive to it. The present truck mounted hammock frame is intended to be designed in order that it can accommodate several sizes of hammocks including a family sized hammock (on the order of 7'×5'), which affords comfortable lounging for two adults.

Designed with ease of use in mind, the current invention is simple to deploy by a single adult in minutes. The parts are manufactured to be sturdy and simple to assemble. It is anticipated that all parts may be attached to the unit so that pieces will not be lost or missing when it comes time to deploy the truck mounted hammock frame. A storage case may be provided for ease of storage and transport.

The positioning and visibility of the truck mounted hammock frame and hammock makes a chosen location easy to see. The hammock sling, or bed, can also provide an extremely visible location for a favorite team logo or promotional print. The uprights of the truck mounted hammock frame provide an ideal location for flags, pennants, kites, or other markers.

The truck mounted hammock frame is ideal for tailgating at sporting events, camping, or relaxing at rest areas, beaches and parks. Offering a mobile platform for a hammock negates the problem of looking for perfectly spaced trees or hauling cumbersome ground frames to a chosen location.

It is also anticipated that the hammock frame may have members added or attached to it in order that it can be deployed on the ground. Such members might include legs, bracing, and support members configured to allow a user to deploy the hammock frame on the ground.

Some important characteristics of the truck mounted hammock frame are anticipated to include, without limitation, the following:

built to support two occupants, and designed to utilize a "family sized" hammock;

360 view above the cab of the truck;

telescoping deployment of the supports;

mounting to the pickup bed rails;

collapsible design and carry case system; and all the other obvious features from the drawing.

| DETAILED DESCRIPTION OF THE PREFERRED EMBODIMENT | |
|---|---|
| 10 | Frame |
| 12 | Narrow sidearm assembly |
| 14 | Narrow sidearm end brace |
| 16 | Anchor |
| 18 | Lock |
| 20 | Narrow sidearm extension |
| 20a | Narrow sidearm extension first end |
| 20b | Narrow sidearm extension second end |
| 22 | Narrow sidearm |
| 22a | Narrow sidearm first end |
| 22b | Narrow sidearm second end |
| 24 | Wide sidearm extension |
| 24a | Wide sidearm extension first end |
| 24b | Wide sidearm extension second end |
| 26 | Wide sidearm |
| 26a | Wide sidearm first end |
| 26b | Wide sidearm second end |
| 28 | Wide sidearm end brace |
| 30 | Wide sidearm assembly |
| 32 | Sidearm support member |
| 34 | Crossbeam Assembly |
| 36a | Crossbeam first strut |
| 36b | Crossbeam second strut |
| 38 | Crossbeam cross piece |
| 40 | Rest |
| 42 | Crossbeam extension |
| 44 | Crossbeam endpiece |
| 46 | Sidearm receiver |
| 48 | Handle |
| 50 | Sidearm guide |
| 52 | Hinge pin |
| 54 | Rail clamp |
| 56 | Center post |
| 58 | Post clamp |
| 60 | Post tip |
| 62 | Post stop |
| 64 | Washer |
| 66 | Fastener |
| 68 | Lock |
| 70 | Pin hole |
| 72 | Receiver fin |
| 74 | Guide hole |

-continued

| DETAILED DESCRIPTION OF THE PREFERRED EMBODIMENT | |
|---|---|
| 76 | Clamp lock |
| 78 | Pressure bar |
| 80 | Jaw |
| 82 | Lip |
| 84 | Wheel |
| 86 | Axle pin |
| 88 | Axle |
| 90 | Extension lock |

Figure 1:
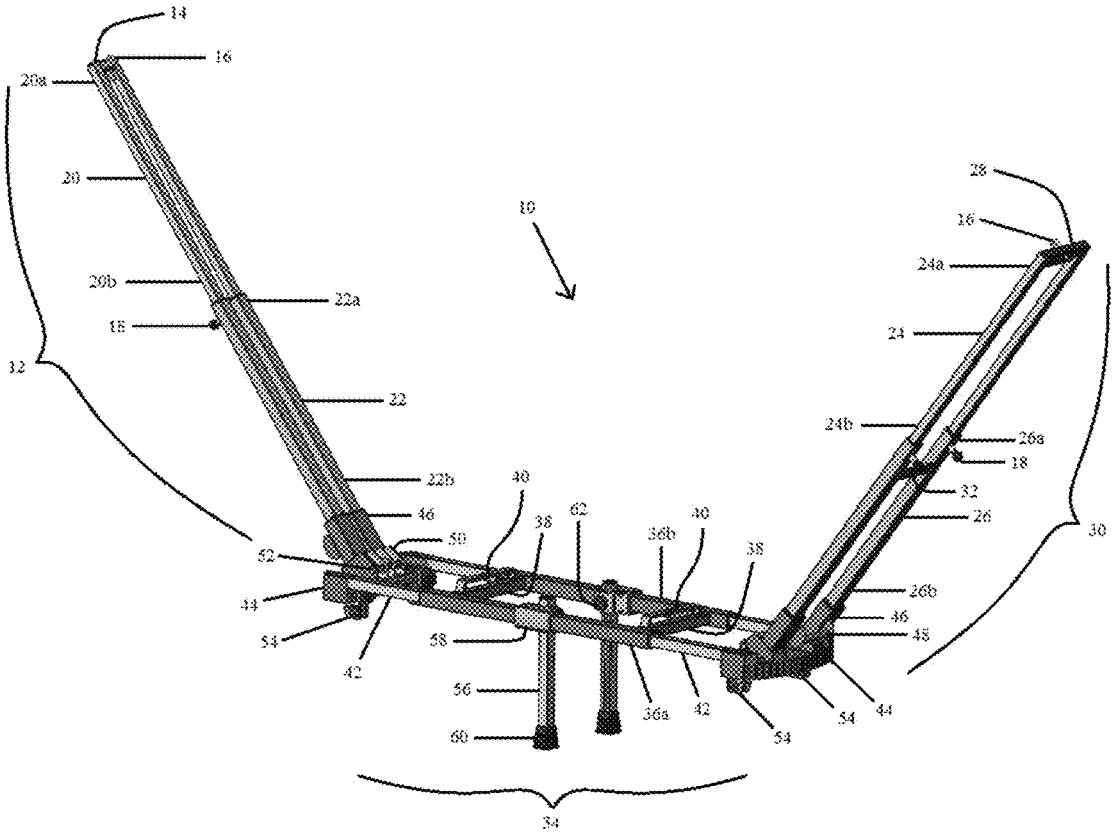
FIG. 1 is a perspective view of a deployed, parallel support hammock frame.

Referring to the figures, FIG. 1 illustrates a perspective view of a deployed automobile, bed mounted hammock frame 10. The hammock frame 10 is a generally U-shaped, double frame for a hammock (not shown). The frame 10 is comprised of a crossbeam assembly 34, a narrow sidearm assembly 12, and a wide sidearm assembly 30. Each of the crossbeam assembly 34, narrow sidearm assembly 12, and wide sidearm assembly 30 are dual beamed, with generally parallel beams. The parallel beams of the assemblies 34, 12, and 30 help reduce torsion and twisting due to forces applied to the frame 10.

The crossbeam assembly 34 is intended to provide the bottom support that spans the area between the sides of the pickup truck bed. The crossbeam assembly 34 has a crossbeam first strut 36*a* and a crossbeam second strut 36*b*. The crossbeam first strut 36*a* and crossbeam second strut 36*b* are generally parallel and may have one (1) or more crossbeam cross pieces 38 attached to the first and second struts 36*a* and 36*b*.

In order to support the center area of the crossbeam assembly 34, the first and second struts 36*a* and 36*b* have center posts 56 attached to them via post clamps 58. The center posts 56 extend downwardly to contact the bed of the pickup and help support the weight of the frame 10 and anything on the frame 10 (such as a hammock or user laying in the hammock).

It is anticipated that the first and second struts 36*a* and 36*b* may be made from hollow tubing. Extending from each end of the first and second struts 36*a* and 36*b* are crossbeam extensions 42. It is anticipated that the first and second struts 36*a* and 36*b* inner diameter, or a portion of the inner diameter, are sized to slide outside of the outer diameter, or a portion of the outer diameter, of the crossbeam extensions 42 in a telescopic movement when urged inwardly or outwardly. The telescopic movement may be arrested by an extension lock 82. The extension lock 82 is anticipated to be any number of known stops such as pins, screws, bolts, friction inducers, clamps, a pin and pin-opening arrangement, or other available height-adjustment mechanism. The extension lock 82 permits the user to adjust the length of the crossbeam assembly 34 to fit the side-to-side pickup bed dimensions.

Also a part of the crossbeam assembly 34 are the crossbeam end pieces 44, which are attached at opposite ends of the crossbeam assembly 34. The crossbeam and pieces 44 act not only to stabilize the crossbeam assembly 34 but also to support rail clamps 54 which attach to the side rails of the pickup. Additionally, the crossbeam and pieces 44 have sidearm guides 50 for receiving and attaching to the sidearms 12 and 30. Also shown in this figure are the rests 40, which are attached on the top side of the crossbeam cross pieces 38.

The crossbeam cross pieces 38 are rotatably attached to the sidearm assemblies 12 and 30. It is intended that the sidearm assemblies 12 and 30 will fold inwardly and be as compact as possible. To this end, one of the sidearm assemblies 12 is manufactured to be slightly narrower than the other sidearm assembly 30. Thus, the narrow sidearm assembly 12 folds forward when the frame 10 is not in use and the narrow sidearm assembly 12 lays against the rests 40. Likewise, the wide sidearm assembly 30 is sized such that when the wide sidearm assembly 30 is rotated forward and stowed, it nestles about the narrow sidearm assembly 12.

The frame 10 may be fixed to a vehicle surface, anticipated to be the bed of a pickup truck however other locations on other vehicles are also anticipated in the use of this invention. The crossbeam assembly 34 may be made of any sufficiently supportive material, such as tube steel, other metal, or plastic. It may be attached in the pickup bed or to the vehicle surface by welding, clamping, fasteners, adhesives, weight friction, or other methods known in the art.

The narrow sidearm assembly 12 is comprised of a parallel, dual beamed narrow sidearm 22. In a first embodiment, the narrow sidearm 22 is comprised of two (2) parallel beams having a first end 22*a*, and a second end 22*b*. The second ends 22*b* slide inside a pair of sidearm receivers 46. The sidearm receivers 46 are rotatably attached to the crossbeam end piece 44 by a hinge pin 52. The narrow sidearm assembly 12 is further comprised of a narrow sidearm extension 20, which has two (2) parallel beams, each having a first end 20*a* and a second end 20*b*. It is anticipated that the narrow sidearm extension 20 may be made from hollow tubing and that the narrow sidearm first ends' 22*a* inner diameter, or a portion of the inner diameter, are sized to slide outside of the outer diameter, or a portion of the outer diameter, of the narrow sidearm extension second ends 22*b* in a telescopic movement when urged inwardly or outwardly. The telescopic movement may be arrested by a lock 18. The lock 18 is anticipated to be any number of known stops such as pins, screws, bolts, friction inducers, clamps, a pin and pin-opening arrangement, or other available height-adjustment mechanism. The lock 18 permits the user to adjust the length of the narrow sidearm assembly 12.

The wide sidearm assembly 30 is comprised of a parallel, dual beamed wide sidearm 26. In a first embodiment, the wide sidearm 26 is comprised of two (2) parallel beams having a first end 26*a*, and a second end 26*b*. The second ends 26*b* slide inside a pair of sidearm receivers 46. The sidearm receivers 46 are rotatably attached to the crossbeam end piece 44 by a hinge pin 52. The wide sidearm assembly 30 is further comprised of a wide sidearm extension 24, which has two (2) parallel beams, each having a first end 24*a* and a second end 24*b*. It is anticipated that the wide sidearm extension 24 may be made from hollow tubing and that the wide sidearm first ends' 24*a* inner diameter, or a portion of the inner diameter, are sized to slide outside of the outer diameter, or a portion of the outer diameter, of the wide sidearm extension second ends 24*b* in a telescopic movement when urged inwardly or outwardly. The telescopic movement may be arrested by a lock 18. The lock 18 is anticipated to be any number of known stops such as pins, screws, bolts, friction inducers, clamps, a pin and pin-opening arrangement, or other available height-adjustment mechanism. The lock 18 permits the user to adjust the length of the wide sidearm assembly 30.

The beams of the sidearm assemblies 12 and 30 are anticipated to be hollow tubes with either circular, ovoid, or polygonal shaped outer walls. When engaged, the lock 18 retains the extensions 20 and 24 in place relative to the sidearms 22 and 26. When disengaged, the lock 18 allows the extensions 20 and 24 to slide in and out of the sidearms 22 and 26. Thus, when the user wishes to deploy the frame 10, the user extends the extensions 20 and 24 and engages the locks 18 so that the sidearm extensions 20 and 24 are held in an extended position from which the hammock (not shown) can be attached and deployed. The first end 20*a* of narrow sidearm extension 20 may be closed with a narrow sidearm end brace 14 attached. Likewise, the first end 24*a* of wide sidearm extension 24 may be closed with a wide sidearm end brace 28 attached. The end braces 14 and 28 maintain the separation of the beams of the extensions 20 and 24, as well as provide support and resistance to torsion and twisting. An anchor 16 is connected to the first ends 20*a* and 24*a* of the sidearm extensions 20 and 24. The anchor 16 is provided to allow for attachment of the hammock (not shown).

Figure 2:
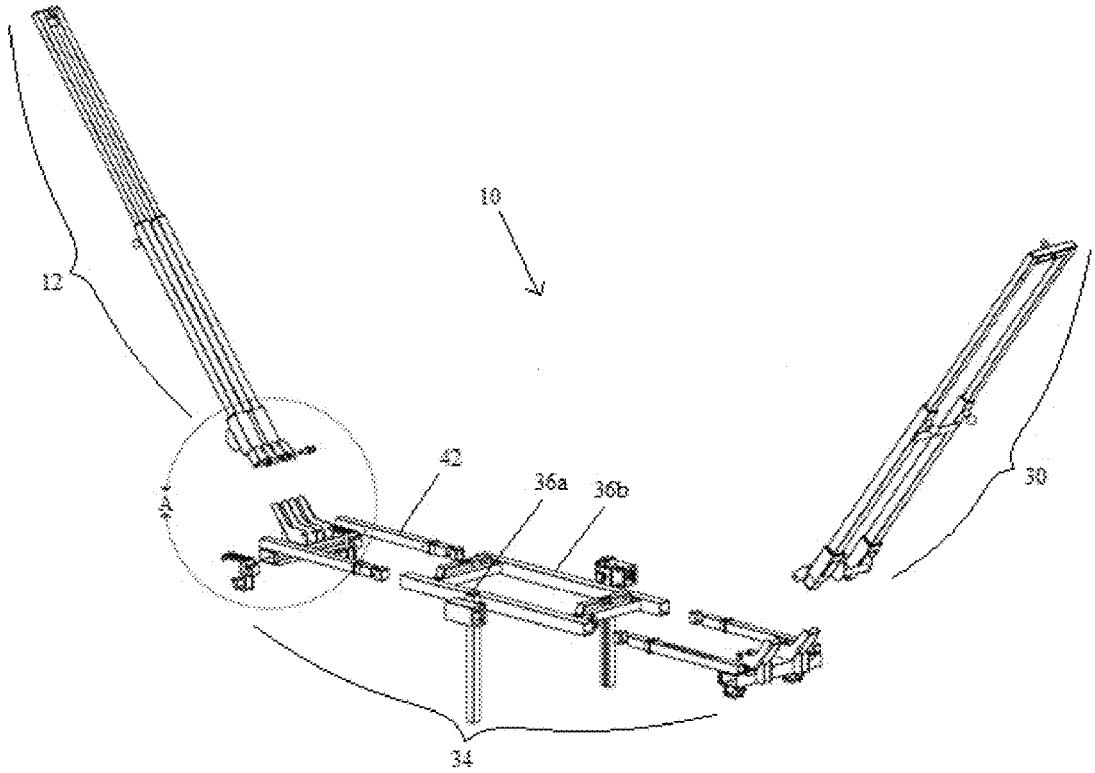
FIG. 2 is an exploded view of a parallel support hammock frame.

FIG. 2 shows an exploded view of the truck mounted hammock frame 10. In this figure, the connections of the sidearm receivers 46 with the end pieces 44 are more easily understood. Likewise, the telescopic action of the crossbeam assembly 34 is shown. As illustrated here, the crossbeam extensions 42 slide into the hollow tubes of the crossbeam first strut 36*a* and the crossbeam second strut 36*b*. Circle "A" is provided to designate a magnified portion of FIG. 2 shown in FIG. 2A.

Figure 2A:
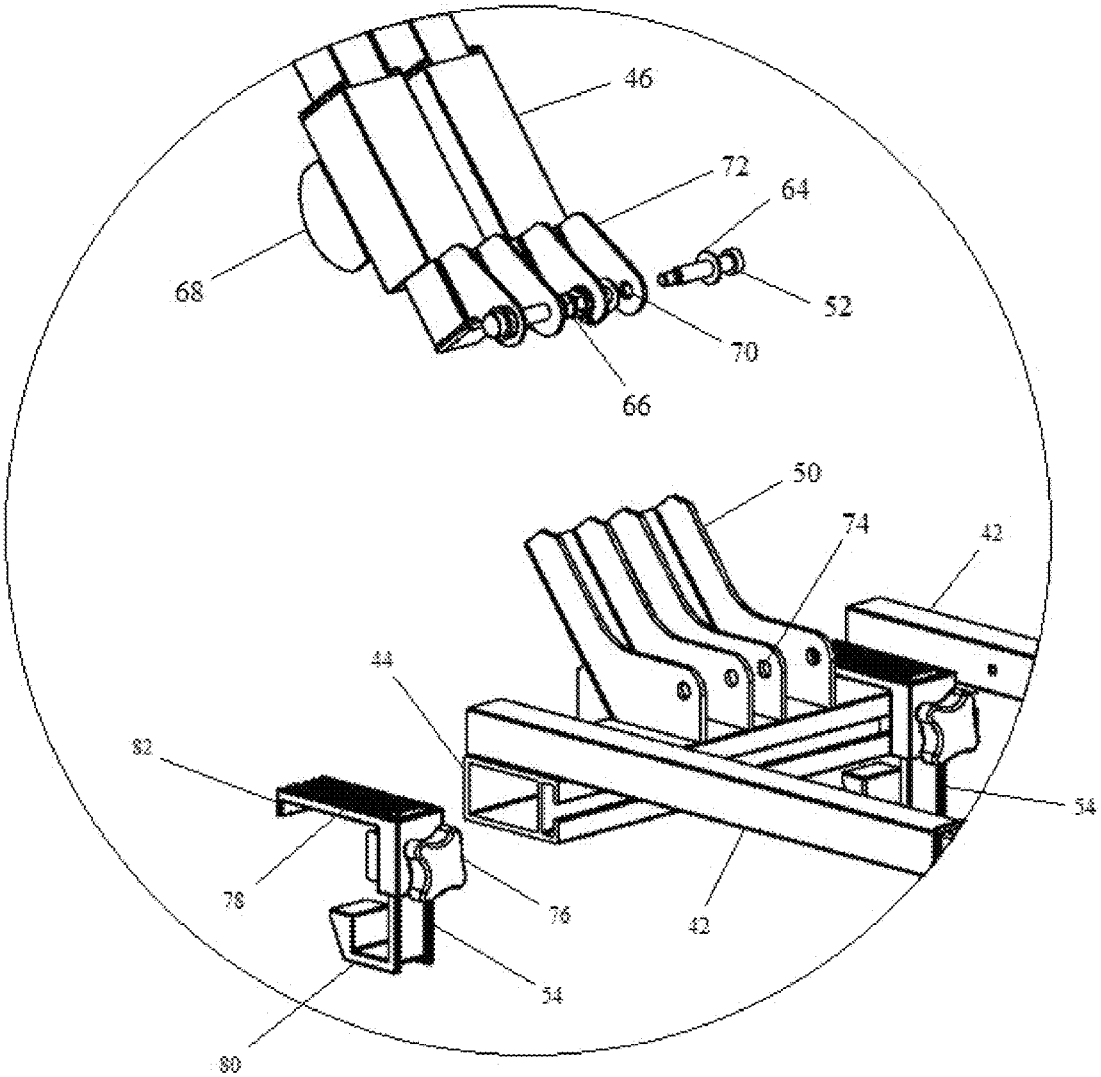
FIG. 2*a* is a close-up, perspective view of circle A from FIG. 2 showing the connection of a sidearm assembly with the crossbeam assembly.

FIG. 2A illustrates the connection of the narrow sidearm extension assembly 12 to the crossbeam assembly 34. (Although not shown in magnification, the wide sidearm extension assembly 30 attaches in the same manner to the opposite end of the crossbeam assembly 34.) In this figure, it is clearly seen how the narrow sidearm second ends 22*b* slide inside the sidearm receivers 46. The narrow sidearm second ends 22*b* are held in place inside the sidearm receivers 46 using a lock 68. The lock 68 is anticipated to be any number of known stops such as pins, screws, bolts, friction inducers, clamps, a pin and pin-opening arrangement, or other available lockdown mechanisms. The lock 68 permits the user to attach and detach the narrow sidearm assembly 12 to the sidearm receivers 46. The sidearm receivers 46 are attached to (or manufactured as a single unit) a receiver fan 72. When the narrow sidearm assembly 12 is to be attached to the crossbeam assembly 44, the sidearm receivers 36 are slid into sidearm guides 50. The sidearm guides 50 are attached to the crossbeam and pieces 44. The sidearm and guides are spaced so as to receive either the narrow sidearm assembly 12 or the wide sidearm assembly 30. The sidearm guides 50 are three sided and generally L-shaped. The sidearm guides 50 have guide holes 74 opposite each other at the end of the L-shape that is attached to the crossbeam and peace 44. The receiver fins 72 have pin holes 70 that line up with the guide holes 74. Thus, when the narrow sidearm assembly 12 and the sidearm receivers 46 are urged into the sidearm guides 50, the pinholes 70 and guide holes 74 are aligned such that a hinge pin 52 can be slid through the pinholes 70 and guide holes 74, rotatably connecting the narrow sidearm assembly 12 to the crossbeam assembly 34. The back of the "L" of the sidearm guide 50 keeps the narrow sidearm assembly 12 from rotating too far opposite the wide sidearm assembly 30. The hinge pin 52 may be held in place by fasteners 66 and washers 64.

Also shown in this figure are magnified views of the rail clamp 54. The rail clamp 54 has something of a "G" shape with a pressure bar 78 on the top that presses down on the crossbeam and peace 44. It can be held in place, in part, on the crossbeam and peace 44 by a lip 82. The rail clamp 54 extends downwardly from the pressure bar 78 ending in a hook shaped jaw 80 designed to catch on the rail of the pickup bed. The rail clamp 54 can be tightened against the rail of the pickup bed using the clamp lock 76.

Figure 3:
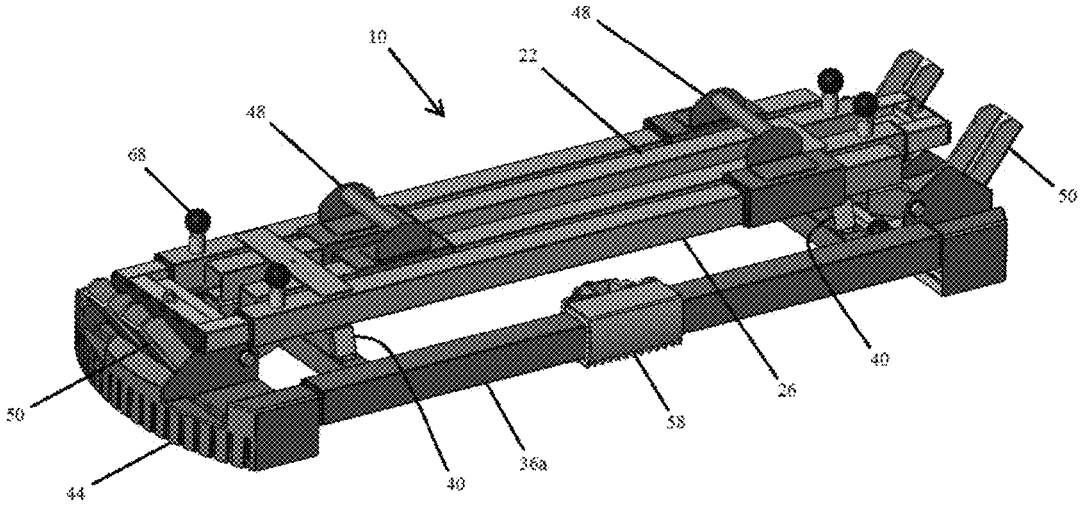
FIG. 3 is a perspective view of a folded, parallel support hammock frame.

FIG. 3 illustrates the hammock frame 10 when it is folded for storage. As shown in this figure, the narrow sidearm assembly 12 can be folded inwardly to rest on the rests 40. Likewise, the wide sidearm assembly 30 can be folded inwardly to rest on the rests 40. The narrow sidearm assembly 12 and the wide sidearm assembly 30 have their beams spaced such that the narrow sidearm assembly 12 nests inside the wide sidearm assembly 30 when the two (2) assemblies are folded. This figure also shows the handles 48 which can be used by the user to help move the sidearm assemblies 12 and 30 or the frame 10.

Figure 4:
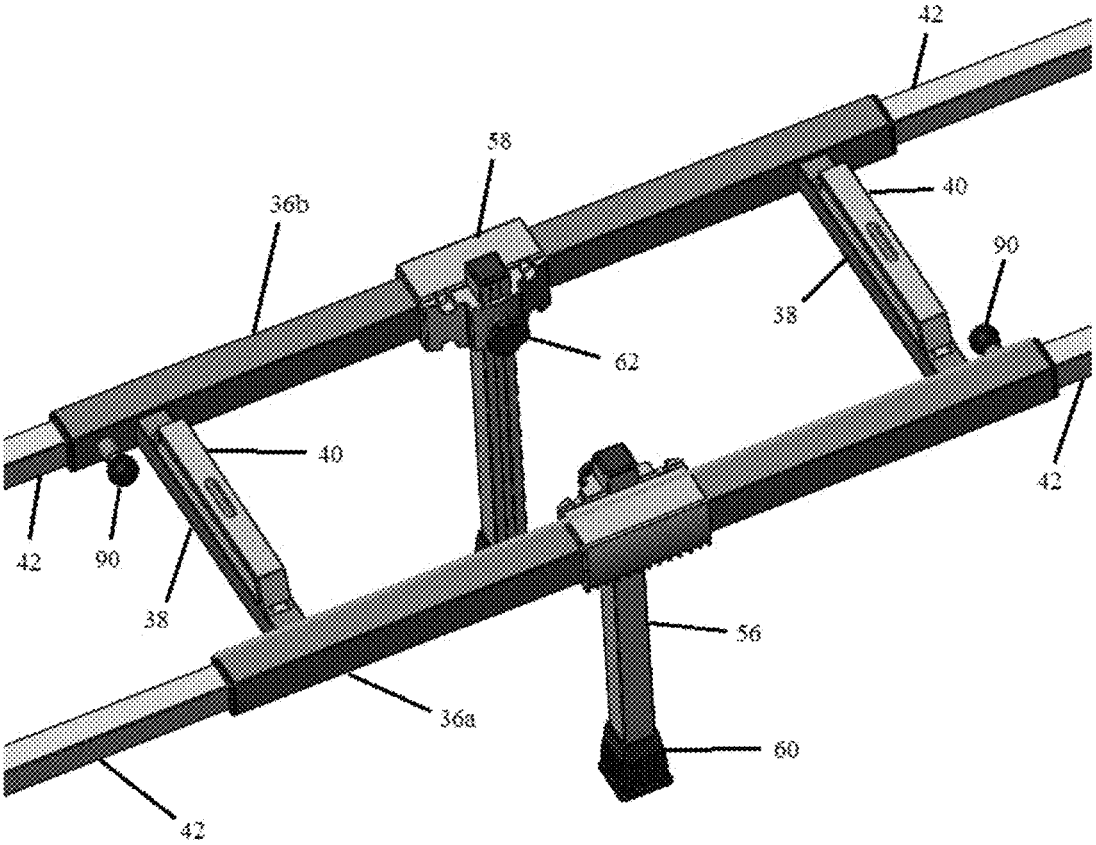
FIG. 4 is a close-up, perspective view of the center portion of the crossbeam assembly.

FIG. 4 is a close up, perspective view of center portion of the crossbeam assembly 34, in particular the crossbeam first strut 36*a* and crossbeam second strut 36*b*. Crossbeam extensions 42 are shown extending from the struts 36*a* and 36*b*, and held in place by extension lock 90. The parallel configuration of the first and second crossbeam struts 36*a* and 36*b* is maintained by the crossbeam cross pieces 38, which also add rigidity to the crossbeam assembly 34. The rests 40 are attached to and extend above the cross pieces 38. This figure also more clearly shows the post clamps 58, which are generally in the middle of the struts 36*a* and 36*b*. The post clamps 58 allow for attachment of the center posts 56, which help support the frame 10 and in particular the center portion of the crossbeam assembly 34. The center posts 56 can be raised and lowered and then locked in place using the post stop 62. If the user wishes to change the height of the frame 10, then the post stop 62 can be loosened, the height of the center posts 56 adjusted, and the post stop 62 tightened in order to lock the center posts 56 in place. A post tip may be attached at the bottom of the center posts 56.

Figure 5:
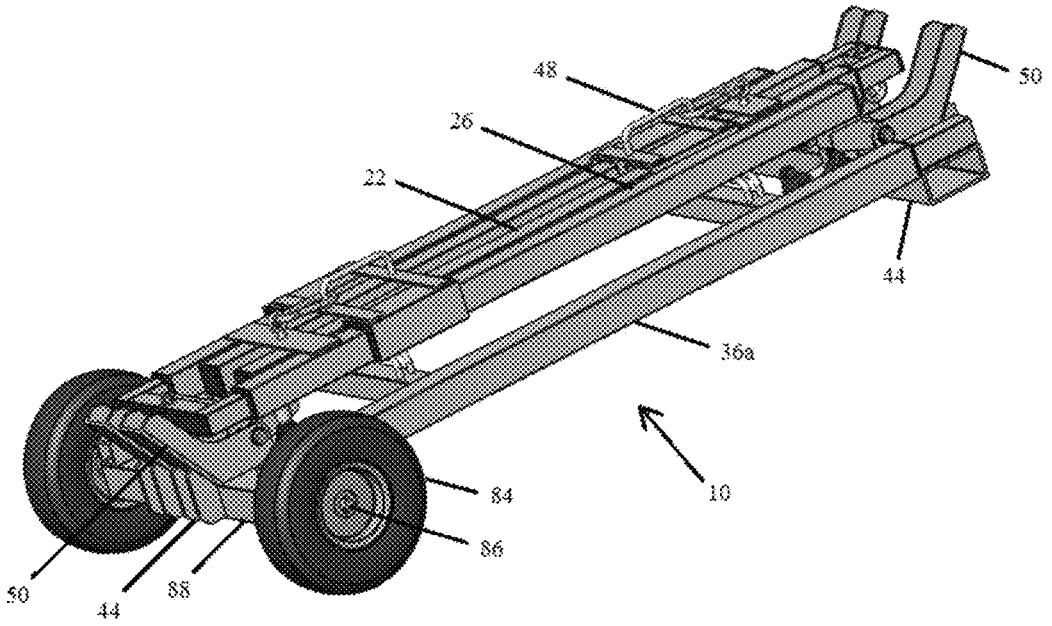
FIG. 5 is a perspective view of a folded, parallel support hammock frame with wheels.

FIG. 5 illustrates the hammock frame 10 when it is folded, but with wheels 84 attached so as to make moving the frame 10 more easy for the user. As shown in this embodiment, axles 88 are attached to the crossbeam endpieces 44. The axles 88 extend outwardly from the crossbeam assembly 34 sufficiently to allow a wheel 84 that is rotatably attached to the axle 88 to rotate without contacting the remainder of the frame 10. If necessary, the wheel 84 may be rotatably attached to the axle 88 via an axle pin 86.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A hammock frame for holding a hammock and deploying in a bed of a vehicle comprising:

a crossbeam assembly, said crossbeam assembly further comprising: a first strut and a second strut held in parallel by two or more cross pieces; an extension member telescopically attached to each end of said first and second struts; and an end piece attached to two of said extension members and opposite said first and second struts; a narrow sidearm assembly rotatably attached to a first end of said crossbeam assembly, said narrow sidearm assembly further comprising: a pair of beams forming a narrow sidearm; and a pair of beams forming a narrow sidearm extension, wherein first ends of said narrow sidearm extension are telescopically attached to said narrow sidearm on narrow sidearm ends that are opposite of said crossbeam assembly; a wide sidearm assembly rotatably attached to a second end of said crossbeam assembly, said wide sidearm assembly further comprising: a pair of beams forming a wide sidearm; and a pair of beams forming a wide sidearm extension, wherein first ends of said wide sidearm extension are telescopically attached to said wide sidearm opposite of said crossbeam assembly; wherein said narrow sidearm assembly has an anchor at an end opposite said crossbeam assembly for connection to said hammock; and said narrow sidearm assembly and said wide sidearm assembly may be folded inwardly and said narrow sidearm assembly nestles inside of said wide arm assembly in a storage position, and said narrow sidearm assembly and said wide sidearm assembly may be extended outwardly in a deployed position.

2. The hammock frame of claim 1, further comprising: a pair of sidearm receivers attachable to a second end of said narrow sidearm, wherein said pair of sidearm receivers are positioned at a distance apart from each other; and a pair of sidearm receivers attachable to a second end of said wide sidearm, wherein said wide sidearm pair of sidearm receivers are positioned at a distance apart from each other.

3. The hammock frame of claim 2, further comprising: a pair of sidearm guides, wherein said sidearm guides are three sided and generally L-shaped; said pair of sidearm guides positioned at a distance apart from each other; said pair of sidearm receivers having a fin with a pinhole; said sidearm guides having guide holes; wherein when said sidearm receivers attached to the narrow sidearm are inserted into said sidearm guides, said pinholes and said guide holes line up; and a hinge pin insertable through said pinholes and said guide holes in order to rotatably attached said narrow sidearm assembly to said crossbeam assembly.

4. The hammock frame of claim 2, further comprising: a first pair of sidearm guides, wherein said first sidearm guides are three sided and generally L-shaped; said first pair of sidearm guides positioned at a distance apart from each other; said first pair of sidearm receivers having a fin with a pinhole; said first sidearm guides having guide holes; wherein when said first sidearm receivers are inserted into said first sidearm guides, said pinholes and said guide holes line up; a hinge pin insertable through said pinholes and said guide holes in order to rotatably attached said narrow sidearm assembly to said crossbeam assembly; a second pair of sidearm guides, wherein said second sidearm guides are three sided and generally L-shaped; said second pair of sidearm guides positioned at a distance apart from each other; said second pair of sidearm receivers having a fin with a pinhole; said second sidearm guides having guide holes; and wherein when said second sidearm receivers are inserted into said second sidearm guides, said pinholes and said guide holes line up; a hinge pin insertable through said pinholes and said guide holes in order to rotatably attached said wide sidearm assembly to said crossbeam assembly.

5. The hammock frame of claim 1, further comprising: an axle attached to each end piece; and a wheel rotatably attached to said axle.

6. The hammock frame of claim 2, further comprising: a handle attached to said narrow sidearm assembly; and a handle attached to said wide sidearm assembly.

7. The hammock frame of claim 2, further comprising a rest attached to said crossbeam assembly.

* * * * *